US005961249A

United States Patent [19]

Hansen et al.

[11] Patent Number: 5,961,249

[45] Date of Patent: Oct. 5, 1999

[54] REMOVABLE AND LOCKABLE BARRIER ASSEMBLY

[75] Inventors: Dennis R. Hansen, Okemos; Clarence M. Hansen, East Lansing, both of Mich.

[73] Assignee: Board of Trustees operating Michigan State University, East Lansing, Mich.

[21] Appl. No.: 09/164,669

[22] Filed: Oct. 1, 1998

Related U.S. Application Data

[60] Provisional application No. 60/060,607, Oct. 1, 1997.

[51] Int. Cl.[6] ..... E01F 9/019

[52] U.S. Cl. ..... 404/9; 404/6; 49/35; 49/131

[58] Field of Search ..... 49/35, 131, 49; 404/6, 9; 256/13.1, 1

[56] References Cited

U.S. PATENT DOCUMENTS

| | | | |
|---|---|---|---|
| 2,315,516 | 4/1943 | Gray | 256/13.1 |
| 3,061,960 | 11/1962 | Dull . | |
| 3,660,935 | 5/1972 | Boots . | |
| 4,003,161 | 1/1977 | Collins . | |
| 4,062,149 | 12/1977 | Collins . | |
| 4,715,742 | 12/1987 | Dickinson | 404/6 |
| 4,762,439 | 8/1988 | Carlyle | 404/6 |
| 5,018,902 | 5/1991 | Miller et al. | 404/6 |
| 5,192,159 | 3/1993 | Higginson | 49/131 |
| 5,365,694 | 11/1994 | Macaluso . | |
| 5,481,828 | 1/1996 | Kentrotas . | |
| 5,509,754 | 4/1996 | Conigliaro . | |
| 5,520,479 | 5/1996 | Hernandez . | |

FOREIGN PATENT DOCUMENTS

| | | | |
|---|---|---|---|
| 1401359 | 4/1964 | France | 49/35 |

*Primary Examiner*—Thomas B. Will
*Assistant Examiner*—Kristine M. Markovich
*Attorney, Agent, or Firm*—Ian C. McLeod; Mary M. Moyne

[57] ABSTRACT

A lockable and removable barrier assembly (10) includes a post (32) which is removably mounted in a sleeve (12). The bottom end (32B) of the post is mounted in the top end (12A) of the sleeve such that a securing opening (14) of the sleeve is aligned with a securing opening (35) of the post. A securing mechanism (42) is located in the inner chamber (32C) of the post. The securing mechanism includes a securing lever (52) which is pivotably mounted at the bottom end (52B) to a mounting bracket (44). The lever includes a securing lug (58) which extends through a securing opening in the post and sleeve to secure the post in position in the sleeve. The top end (52A) of the lever is held in the secured position by a lock (60) which extends through a hole in the end of the lever and through a hole in the locking bracket (48) mounted on the sidewall of the post in the inner chamber. The sleeve is permanently mounted in a ground surface (100) and when not in use, the top end of the sleeve is closed by a sleeve cover (28).

20 Claims, 5 Drawing Sheets

REMOVABLE AND LOCKABLE BARRIER ASSEMBLY

This application claims the benefit of U.S. Provisional Application Serial No. 60/060,607 filed Oct. 1, 1997.

BACKGROUND OF THE INVENTION (1) Field of the Invention

The present invention relates to a barrier assembly which allows for easy removal of the post of the assembly while allowing the flush mounted sleeve of the assembly to remain in the ground surface. In particular, the present invention relates to a barrier assembly which has an internal securing mechanism within the post which allows for securely mounting the post to the sleeve and allows for quick and easy and unsecuring removal of the post from the sleeve.

(2) Description of the Related Art

The related art has shown various types of removable barrier assemblies. Illustrative are U.S. Pat. Nos. 3,660,935 to Boots; 4,003,161 to Collins; 4,062,149 to Collins; 5,192,159 to Higginson; 5,365,694 to Macaluso; 5,481,828 to Kentrotas; 5,509,754 to Conigliaro and 5,520,479 to Hernandez.

In particular, Kentrotas, Macaluso, Higginson, Boots and Collins '161 show barrier posts where the top post is telescopingly mounted within the sleeve or bottom member or sleeve. When not in use, the top post is moved completely within the bottom member. Hernandez, Conigliaro and Collins '149 show barrier assemblies having a removable top post.

In all of the above patents, a portion of the securing mechanism is on the outside of the post and easily accessible and exposed to the outside elements.

Only of minimal interest is U.S. Pat. No. 3,061,960 to Dull which shows a parking post which can be pivoted from a vertical to a horizontal position when not in use.

There remains the need for a simple barrier assembly having a top post which is easily unsecured and removed from the bottom sleeve where the securing mechanism is located completely within the top post and protected from the outside elements and where a standard, separate lock is used to lock the securing mechanism. There also remains the need for a simple barrier assembly where the flush mounted sleeve is not a surface obstruction for people, equipment or snow removal and wherein the portion of the locking mechanism which remains in the sleeve is protected from damage.

SUMMARY OF THE INVENTION

The present invention is a barrier assembly having a post removably mounted in a sleeve. The sleeve is fixedly mounted in the ground surface with the top, open end spaced slightly below the top of the ground surface. When not in use, a sleeve cover is positioned over the top end of the sleeve. The sleeve cover is preferably flush with the ground surface. The post is mounted in the sleeve and is secured in place by a securing mechanism located completely within the barrier assembly. The positioning of the securing mechanism completely within the barrier assembly protects the securing mechanism from the elements. The securing mechanism includes a securing lever with a securing lug extending outward from the securing lever. The lever is pivotably mounted to the sidewall of the post such that when the post is mounted in the sleeve, the lever can be pivoted such that the securing lug extends through a securing hole in the sidewall of the post and through a securing hole in the adjacent sidewall of the sleeve. A lock is used to secure the lever to a bracket on the sidewall of the post to hold the lever in the secured position. Once unlocked and moved into the unsecured position, the lever remains in the unsecured position until moved by the user.

The substance and advantages of the present invention will become increasingly apparent by reference to the following drawings and the description.

BRIEF DESCRIPTION OF THE DRAWING(S)

FIG. 1 is a perspective view of the barrier assembly 10 of the present invention in use.

FIG. 2 is a perspective view of the cover 28 of the open top end 12A of the sleeve 12 of the barrier assembly 10 with the post 32 removed.

FIG. 3 is a cross-sectional view along the line 3—3 of FIG. 1 showing the sleeve 12, the post 32 and the securing mechanism 42 in the secured position.

FIG. 4 is a side view along the line 4—4 of FIG. 3 showing the access covering 38 in front of the access opening 36 and across from the locking bracket 48.

FIG. 5 is a view along the line 5—5 of FIG. 3 of the securing lug 58 in the cavity 16B formed by the hollow cap 16 on the first sidewall 12D of the sleeve 12.

FIG. 6 is a side view along the line 6—6 of FIG. 3 showing the securing lever 52 in the secured position locked to the locking bracket 48 and pivotably mounted to the mounting bracket 44.

FIG. 7 is a cross-sectional view of the barrier assembly 10 with the securing mechanism 42 in the unsecured position and the post 32 partially removed from the sleeve 12.

FIG. 8 is a cross-sectional view along the line 8—8 of FIG. 2 showing the sleeve cover 28 on the sleeve 12 and the drainage tubes 22 leading to the drainage fields 24.

DESCRIPTION OF THE PREFERRED EMBODIMENT(S)

Figure 1:
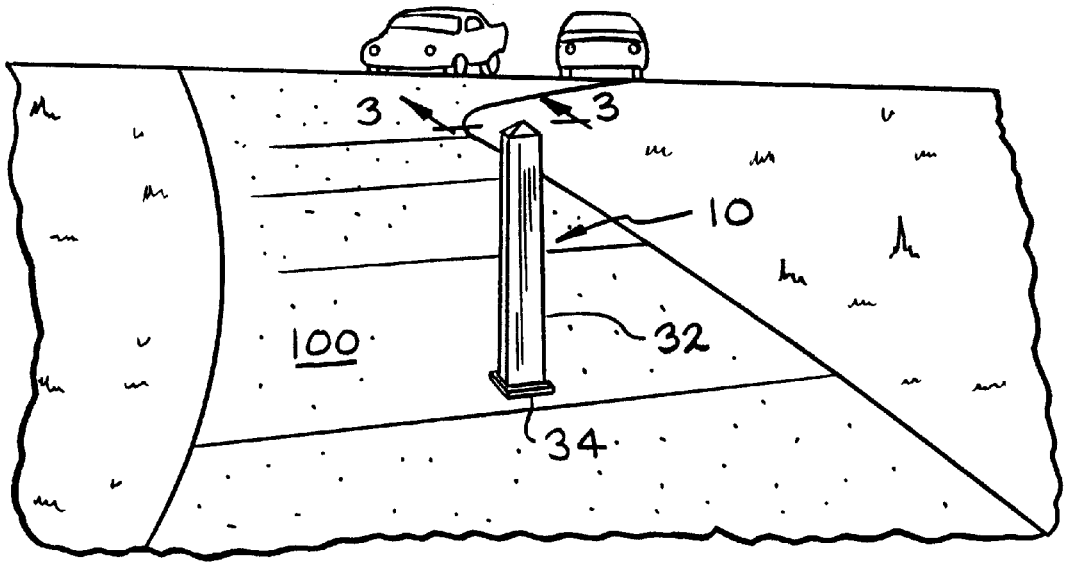

The present invention relates to a barrier assembly which comprises: a sleeve adapted for mounting in a ground surface, the sleeve having opposed first and second ends with a sidewall extending therebetween forming an inner chamber, the sleeve having a first opening in the first end extending into the inner chamber and a second opening in the sidewall of the sleeve with a hollow cap mounted on the sidewall over the second opening and extending outward from the sidewall of the sleeve away from the inner chamber, the hollow cap having a closed end opposite the second opening such as to form an enclosed cavity within the cap; a post adapted to be removably mounted in the first opening in the first end of the sleeve and having first and second ends with a sidewall therebetween forming an inner chamber, the sidewall having a first opening extending into the inner chamber of the post; and a securing means having opposed ends and pivotably mounted at one end to the sidewall of the post in the inner chamber of the post, the securing means having a securing lug mounted between the ends and adjacent the first opening in the sidewall of the post wherein the securing lug extends outward from the securing means and wherein when the post is mounted in the sleeve, the second opening in the sidewall of the sleeve is adjacent the first opening in the sidewall of the post so that in a secured position, the securing lug of the securing means extends through the first opening of the post into the second opening of the sleeve to secure the post in position in the sleeve and wherein once moved into an unsecured position, the securing means remains in the unsecured position to allow for removal of the post.

Further, the present invention relates to a method for installing a removable barrier assembly, which comprises the steps of: providing a barrier assembly having a sleeve adapted for flush mounting in a ground surface so that no part of the sleeve extends above the ground surface, the sleeve having opposed first and second ends with a sidewall extending therebetween forming an inner chamber, the sleeve having a first opening in the first end extending into the inner chamber and a second opening in the sidewall of the sleeve with a hollow cap mounted on the sidewall over the second opening and extending outward from the sidewall of the sleeve away from the inner chamber, the hollow cap having a closed end opposite the second opening such as to form an enclosed cavity within the cap; a post adapted to be removably mounted in the first opening in the first end of the sleeve and having first and second ends with a sidewall therebetween forming an inner chamber, the sidewall having a first opening extending into the inner chamber of the post; and a securing means having opposed ends and pivotably mounted at one end to the sidewall of the post in the inner chamber of the post, the securing means having a securing lug mounted between the ends and adjacent the first opening in the sidewall of the post wherein the securing lug extends outward from the securing means and wherein when the post is mounted in the sleeve, the second opening in the sidewall of the sleeve is adjacent the first opening in the sidewall of the post so that in a secured position, the securing lug of the securing means extends through the first opening of the post into the second opening of the sleeve to secure the post in position in the sleeve and wherein once moved into an unsecured position, the securing means remains in the unsecured position to allow for removal of the post; mounting the sleeve in the ground surface so that the first end of the sleeve is spaced below a top of the ground surface; inserting the second end of the post into the opening in the first end of the sleeve so that the first opening of the post is adjacent the second opening of the sleeve; and moving the securing means into the secured position so that the securing lug extends through the second opening of the post and into the second opening of the sleeve.

Figure 2:
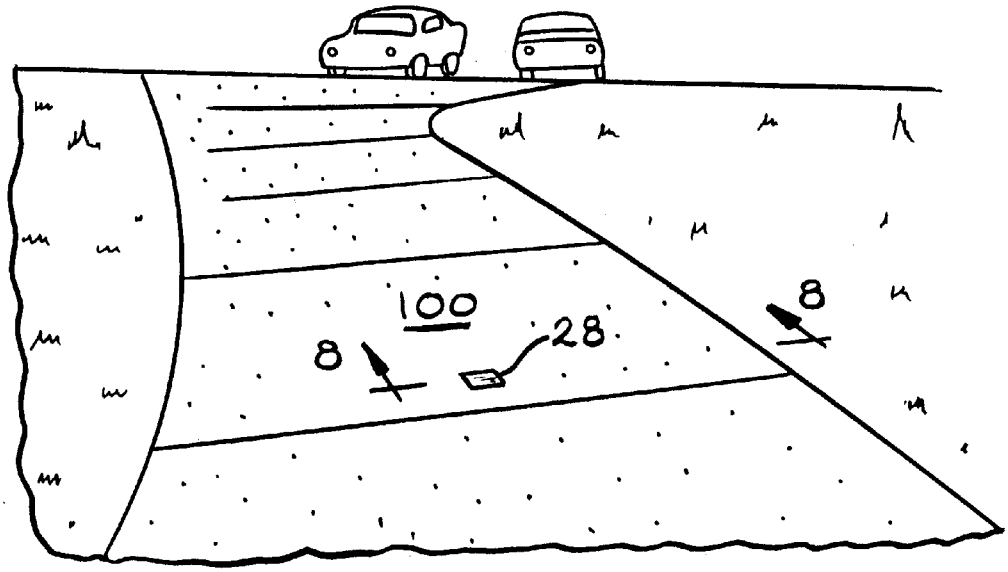
Figure 3:
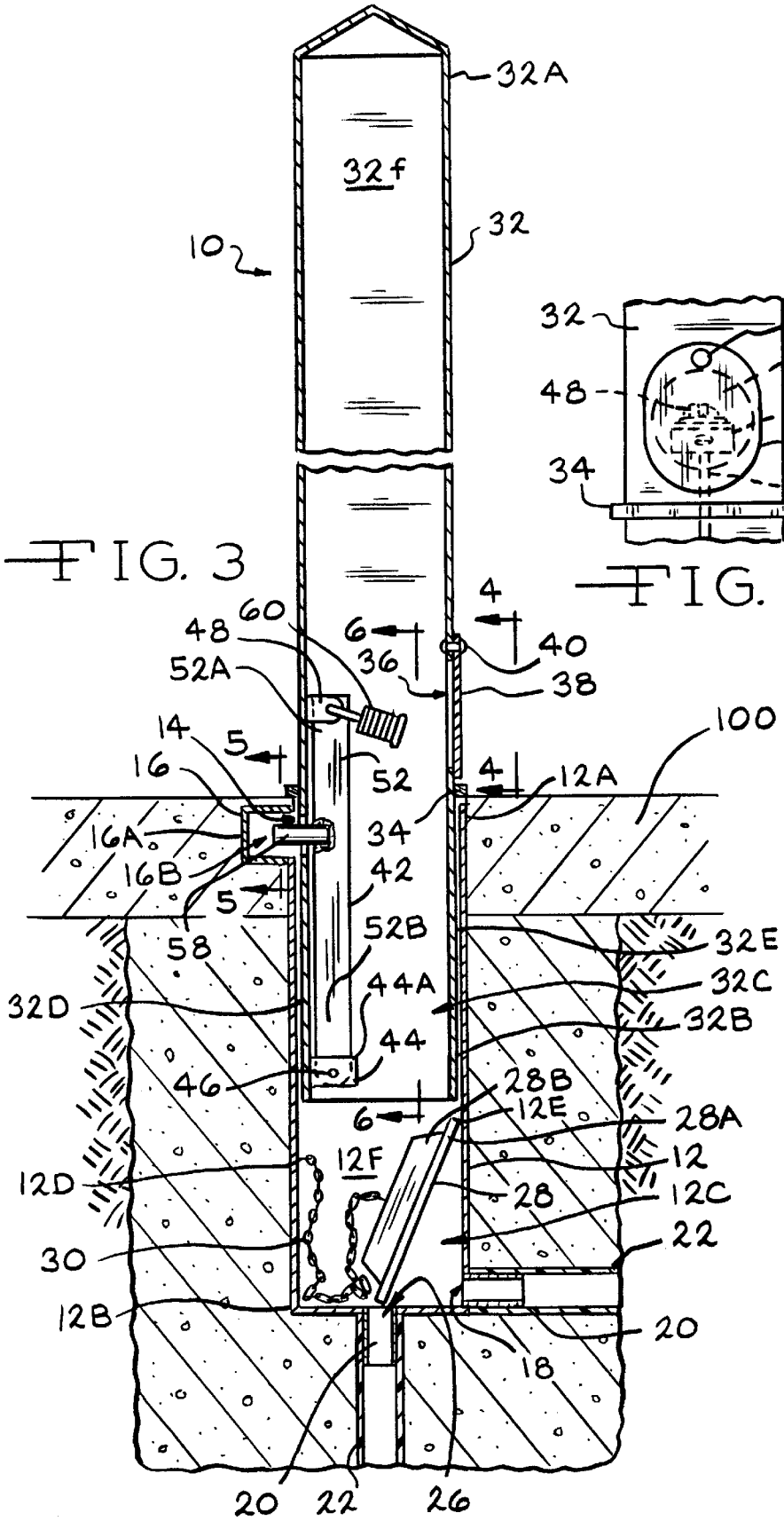
Figure 9:
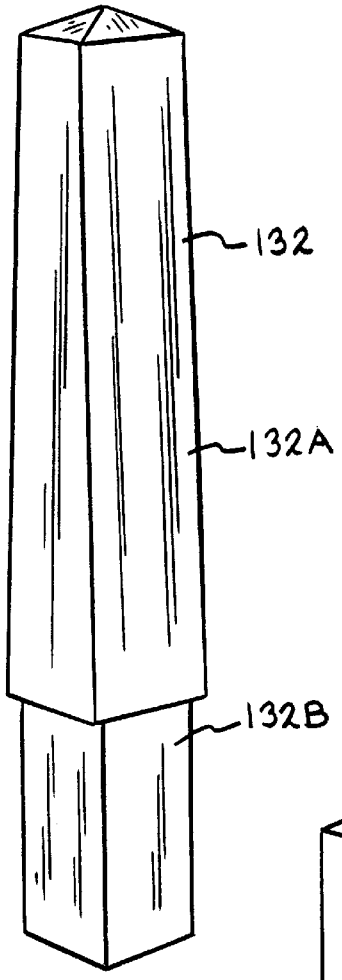
FIG. 9 is a perspective view showing the post 132 of an alternate embodiment of the barrier assembly 10.
Figure 10:
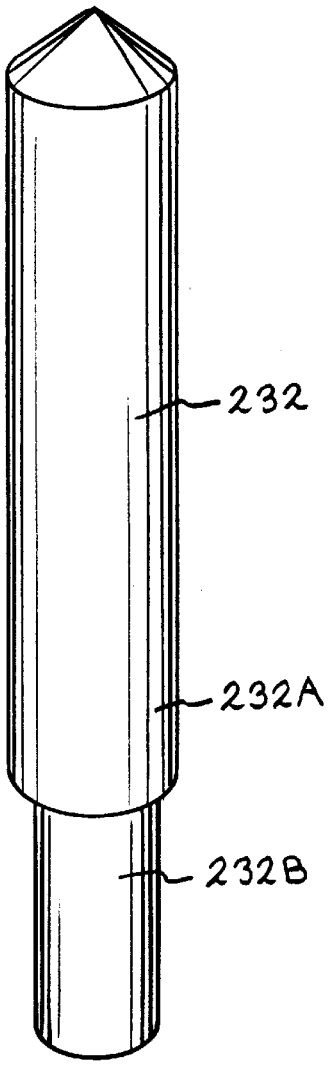
FIG. 10 is a perspective view showing the post 232 of an alternate embodiment of the barrier assembly 10.
Figure 11:
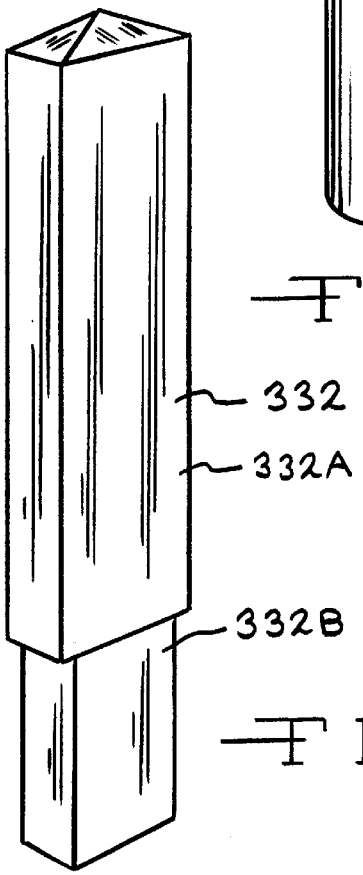
FIG. 11 is a perspective view showing the post 332 of another alternate embodiment of the barrier assembly 10.

FIGS. 1 to 3 show the removable and lockable barrier assembly 10 of the present invention. The assembly 10 includes a lower portion or sleeve 12 and an upper portion or post 32. The sleeve 12 is adapted for mounting in a ground surface 100. The sleeve 12 is hollow having an open top end 12A and a closed bottom end 12B with at least one sidewall 12D extending therebetween forming an inner chamber 12C. The sleeve 12 can have a wide variety of cross-sectional shapes. Some Examples are shown in FIGS. 9 to 11. However, the cross-sectional shape of the sleeve 12 is preferably similar to the cross-sectional shape of at least the bottom end 32B of the post 32 (to be described in detail hereinafter). In the preferred embodiment, the sleeve 12 has a square cross-sectional shape having four (4) sidewalls 12D, 12E, 12F and 12G. The sleeve 12 is provided with a securing opening 14 in a first sidewall 12D adjacent the open top end 12A of the sleeve 12. A hollow, cylindrical cap 16 having a closed end 16A is preferably mounted on the securing opening 14 on the outer surface of the sleeve 12. The cap 16 forms a cavity 16B for the securing lug 58 and prevents the surrounding ground surface such as the concrete pavement from clogging the opening 14 or hindering movement of the securing mechanism 42 (to be described in detail hereinafter). The cap 16 is preferably provided with a drain hole (not shown) adjacent the closed end 16A of the cap 16.

Figure 8:
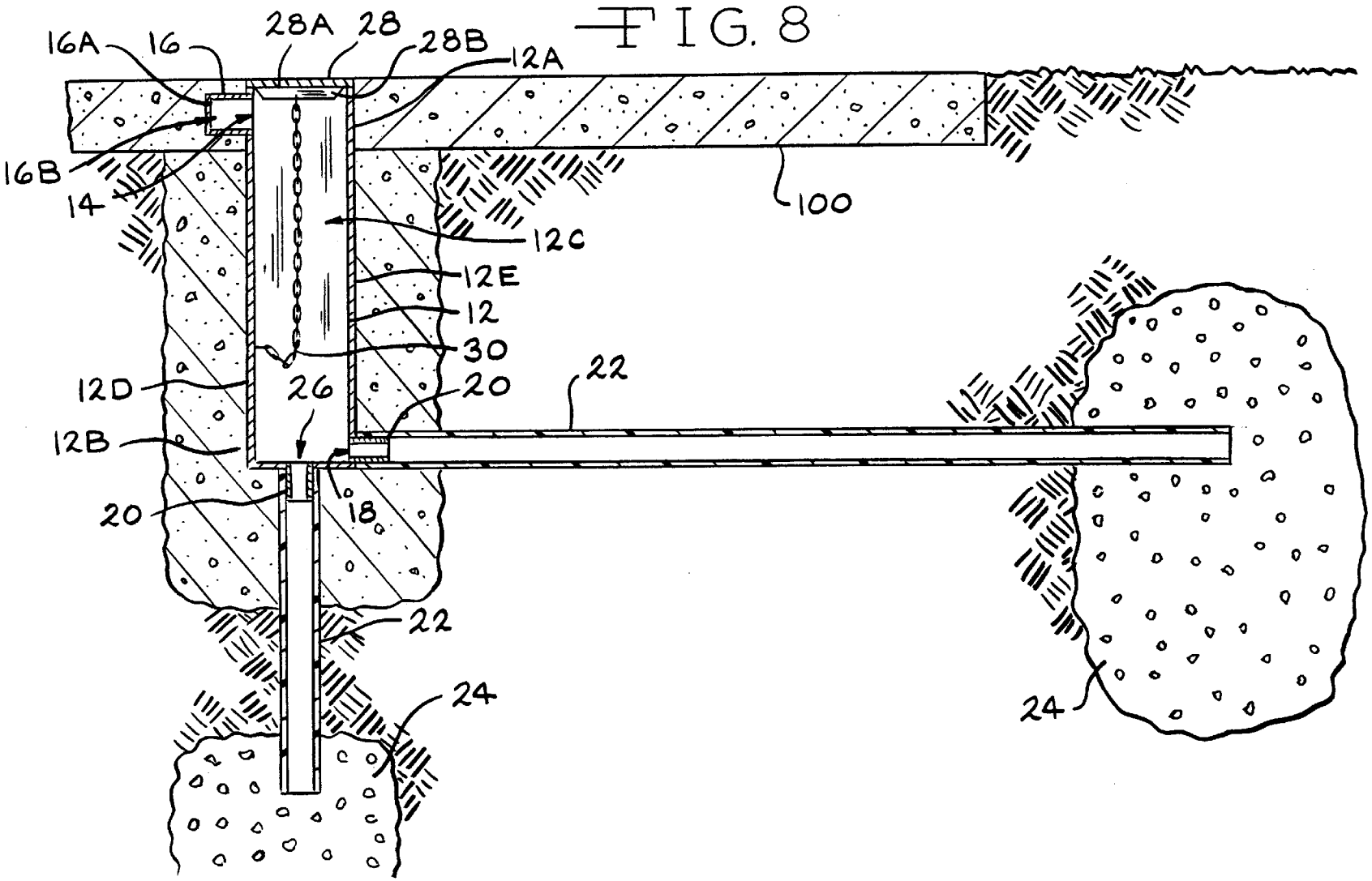

The closed bottom end 12B of the sleeve 12 is preferably provided with a first drain outlet 18 (FIG. 3). A drain conduit 20 is preferably mounted on the drain outlet 18 on the side opposite the inner chamber 12C of the sleeve 12. A drainage tube 22 can be connected to the end of the drain conduit 20 opposite the drain outlet 18 to move the drained liquids away from the sleeve 12 and preferably to a drainage field 24 (FIG. 8). Alternatively, the drain conduit 20 can lead directly to a drainage field 24. In the preferred embodiment, a second drain outlet 26 is provided on one of the sidewalls 12D, 12E, 12F or 12G of the sleeve 12 adjacent the closed bottom end 12B. The second optional drain outlet 26 is preferably similar to the first drain outlet 18 and can be provided with a drain conduit 20 and a drainage tube 22 (FIG. 8).

A sleeve cover 28 is movably stored in the inner chamber 12C of the sleeve 12. The cover 28 has a top portion 28A and a bottom portion 28B. The bottom portion 28B is flexibly connected to the inner surface of the first sidewall 12D of the sleeve 12 (FIG. 3). However, the cover 28 can be connected to any sidewall 12D to 12G of the sleeve 12. The cover 28 is preferably connected to the sidewall 12D of the sleeve 12 by a chain 30. The chain 30 is connected to the sidewall 12D below the bottom end 32B of the post 32 when the post 32 is mounted in the sleeve 12. The chain 30 is preferably of such a length that the cover 28 can be completely removed from the sleeve 12 and can be extended slightly beyond the open top end 12A of the sleeve 12. The top portion 28A of the cover 28 has a shape similar to the cross-sectional shape of the sleeve 12 and has an outer perimeter size preferably equal to the outer perimeter size of the top end 12A of the sleeve 12. The bottom portion 28B of the cover 28 is preferably a rectangular plate which extends outward from the top portion 28A and diagonally across the bottom surface of the top portion 28A. The bottom portion 28B preferably has angled sides such that the length of the bottom portion 28B decreases as the bottom portion 28B extends outward away from the top portion 28A. The angled sides allow for easier positioning of the cover 28 over the open top end 12A of the sleeve 12. The top portion 28A of the cover 28 is preferably constructed of galvanized steel having a thickness of 0.0625 inches (0.1588 cm). The bottom portion 28B is also preferably constructed of galvanized steel and has a thickness of 0.1875 inches (0.4763 cm). The bottom portion 28B preferably has a length of 7.25 inches (18.42 cm) at its base adjacent the top portion 28A. In the preferred embodiment, the bottom portion 28B extends outward from the top portion 28A about 1.0 inch (2.5 cm).

In the preferred embodiment, the sleeve 12 is preferably constructed of galvanized steel having a thickness of 0.125 inch (0.3175 cm). The sleeve 12 in the preferred embodiment has a height of 20 inches (51 cm) and has a width and length of 6.75 inches (17.15 cm). The height of the sleeve 12 is preferably greater than the portion of the post 32 which is inserted into the sleeve 12 such as to allow for storage of the sleeve cover 28 in the bottom of the sleeve 12 when the cover 28 is not in use (FIG. 3). Preferably, the securing opening 14 is 0.375 inches (0.953 cm) from the open top end 12A of the sleeve 12 and has a diameter of about 1.75 inches (4.45 cm). The cap 16 preferably has an outer diameter of 2.0 inches (5.1 cm) and is constructed of galvanized steel having a thickness of 0.125 inches (0.3175 cm). The cap 16 covering the securing opening 14 preferably extends outward from the sidewall 12D of the sleeve 12 about 1.875 inches (4.763 cm).

The post 32 of the barrier assembly 10 has a top and bottom end 32A and 32B with at least one sidewall 32D extending therebetween and forming an inner chamber 32C. The post 32 is preferably hollow between the ends 32A and 32B. The top end 32A of the post 32 is preferably closed. In the preferred embodiment, the bottom end 32B is open to allow any water entering the post 32 to flow into the sleeve 12 and out the drain outlets 20 and 26. The post 32 preferably has a cross-sectional shape similar to the shape of the sleeve 12 (FIG. 9). In a preferred embodiment, the post 32 has a square cross-sectional shape having four (4) sidewalls 32D, 32E, 32F and 32G. The top portion of the post 32 preferably has the same cross-sectional shape as the bottom end 32B of the post 32 and the post 32 is constructed as a single piece (FIG. 3). The top portion of the post 32 above the stop 34 which extends above the sleeve 12 can have a variety of shapes. The top portion can have the shape of figures. In addition, the top portion can have a shape to resemble posts from historical times such as a victorian or colonial post. An end cap (not shown) can be used to cover the top end 32A to allow the top end 32A of the post 32 to have a variety of different shapes. In the preferred embodiment, the top end 32A of the post 32 is pointed to prevent persons from placing objects on the top of the barrier assembly 10. In an alternate embodiment (not shown), the top of the barrier post 32 is rounded. The post 32 does not need to have the same shape along its length. The bottom end 32B of the post 32 has an outer perimeter size less than the perimeter size of the inner chamber 12C of the sleeve 12. The bottom end 32B of the post 32 is preferably of such a size as to allow the bottom end 32B of the post 32 to be easily inserted into the open top end 12A of the sleeve 12. However, preferably the bottom end 32B of the post 32 is of such a size as to prevent extraneous side to side movement of the post 32 in the sleeve 12. In addition, the weight of the post 32 will tend to reduce unwanted extraneous movement of the post 32. In the preferred embodiment where the top end 32A and bottom end 32B of the post 32 have the same cross-sectional size and shape, a stop ring 34 is preferably mounted around an outside surface of the post 32 adjacent the bottom end 32B. The stop ring 34 extends outward from the outer surface of the post 32 about 0.25 inches (0.64 cm). The post 32 with the stop ring 34 has an outer perimeter size greater than the open top end 12A of the sleeve 12. Thus, when the post 32 is inserted into the sleeve 12, the stop ring 34 contacts the top end 12A of the sleeve 12 and prevents the post 32 from extending further into the sleeve 12. Alternatively, the post 132, 232 or 332 can be constructed as an upper portion 132A, 232A or 332A and a lower portion 132B, 232B or 332B (FIGS. 9 to 11). The lower portion 132B, 232B or 332B is preferably of such a size as to allow for insertion of the lower portion 132B, 232B or 332B into the sleeve 12. However, the upper portion 132A, 232A or 332A of the post 132, 232 or 332 is larger in size such that the upper portion 132A, 232A or 332A can not extend into the sleeve 12. Further, the intersection of the lower portion 132B, 232B or 332B and the upper portion 132A, 232A or 332A forms a shoulder which rests on the top end 12A of the sleeve 12.

The first sidewall 32D of the post 32, below the stop ring 34, is provided with a securing opening 35. When the bottom end 32B of the post 32 is correctly mounted in the open top end 12A of the sleeve 12, the first sidewall 12D of the sleeve 12 is adjacent the first sidewall 32D of the post 32 and the securing opening 35 of the post 32 is preferably aligned with the securing opening 14 of the sleeve 12. The securing opening 35 preferably has a diameter of 2.0 inches (5.1 cm) and is spaced 0.5 inches (1.3 cm) from the bottom of the stop ring 34.

Figure 4:
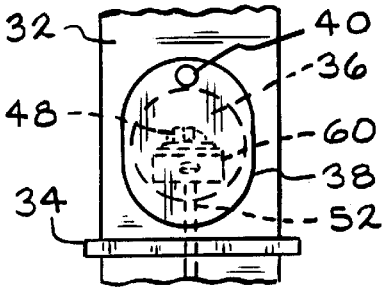

The second sidewall 32E of the post 32 is provided with an access opening 36 spaced above the stop ring 34 (FIGS. 3 and 4). The access opening 36 is located such that when the post 32 is mounted in the sleeve 12, the access opening 36 is spaced above the sleeve 12. The access opening 36 is preferably located opposite and above the securing opening 35 and directly opposite the lock 60, locking bracket 48 and top end 52A of the securing lever 52 (FIG. 4). The access opening 36 is preferably of such a size as to allow an average adult human to easily insert a hand through the opening 36. In the preferred embodiment, the access opening 36 has a circular shape and has a diameter of not less than 4.0 inches (10.2 cm).

A movable access cover 38 is mounted on the outside surface of the second sidewall 32E of the post 32, directly over the access opening 36 (FIG. 4). The cover 38 preferably has an outer perimeter size greater than the diameter of the access opening 36. The cover 38 is preferably mounted to the second sidewall 32E by a bolt or pin 40 which extends through the sidewall 32E and allows the cover 38 to be pivoted on the sidewall 32E. The cover 38 is mounted to the sidewall 32E at its top end such that the cover 38 automatically rotates into a closed position over the access opening 36 due to gravity. The cover 38 preferably has an oval shape to allow for mounting to the sidewall 32D of the post 32 and to cover the access opening 36. The cover 38 is preferably constructed of galvanized steel.

Figure 7:
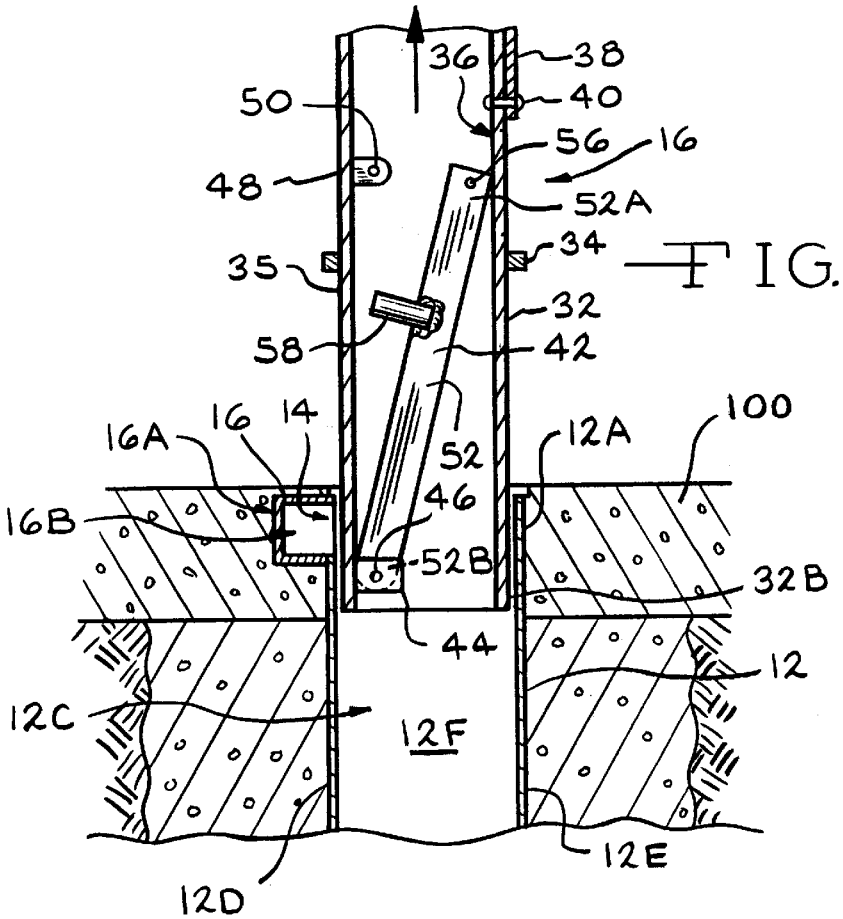
Figure 6:
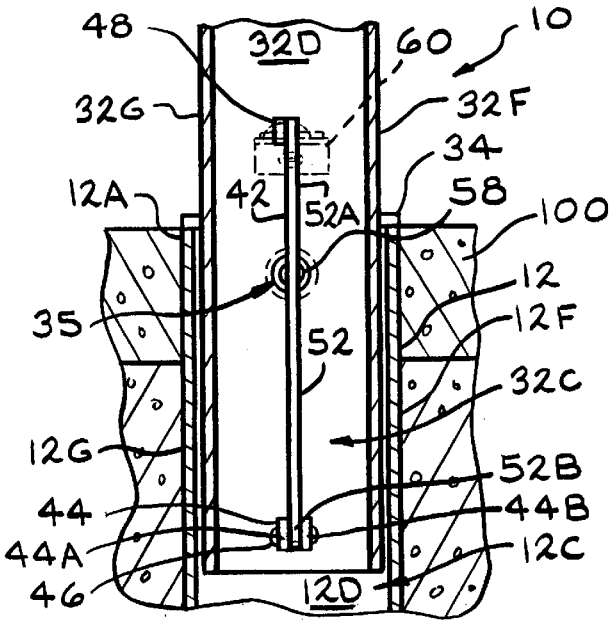

A securing mechanism 42 is mounted within the inner chamber 32C of the post 32. The securing mechanism 42 includes a securing lever 52 with a securing lug 58, a mounting bracket 44 having a pivot pin 46 and a locking bracket 48. The mounting bracket 44 is preferably mounted on the inside surface of the first sidewall 32D of the post 32 adjacent the bottom end 32B of the post 32 (FIGS. 3 and 7). The mounting bracket 44 is preferably mounted on the first sidewall 32D spaced directly below the securing opening 35. The bracket 44 preferably includes a left and right side 44A and 44B with a pivot pin 46 extending therebetween (FIG. 6). The pivot pin 46 is preferably spaced about 1.0 inches (2.5 cm) from the sidewall 32D of the post 32. However, the spacing of the pivot pin 46 from the sidewall 32D can vary depending on the position of the lug 58 on the lever 52 and the location of the securing openings 14 and 35.

The locking bracket 48 is mounted on the first sidewall 32D of the post 32 spaced directly above the securing opening 35 and above the stop ring 34. The locking bracket 48 is preferably positioned directly across from the access opening 36. The bracket 48 is preferably a plate mounted at one end to the inside surface of the sidewall 32D and extending outward away from the sidewall 32D (FIG. 6). The other end of the bracket 48 preferably has rounded corners to reduce injury to the user. The bracket 48 has a hole 50 which extends parallel to and is preferably spaced a distance of 1.3125 inches (3.3338 cm) away from the first sidewall 32D (FIG. 7).

Figure 5:
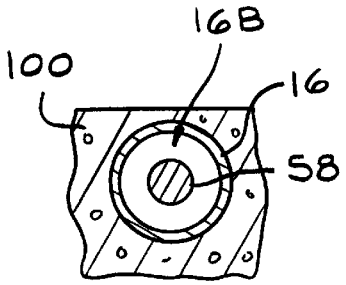

The securing lever 52 is preferably pivotably mounted at the bottom end 52B between the sides 44A and 44B of the mounting bracket 44 such that the pin 46 extends through a hole (not shown) in the bottom end 52B of the lever 52. The lever 52 is mounted such that the bottom end 52B of the lever 52 is spaced above the bottom end 32B of the post 32 such that the lever 52 is able to pivot about the pin 46 without the end 52B of the lever 52 extending beyond the open bottom end 32B of the post 32. In the preferred embodiment, the lever 52 is mounted such that the end 52B of the lever 52 is about 0.75 inches (1.91 cm) above the bottom end 32B of the post 32. In addition, the corners of the bottom end 52B of the securing lever 52 can be rounded (FIGS. 3 and 7). The securing lever 52 extends upward from the mounting bracket 44 toward the locking bracket 48 such that when in the secured position, a securing hole 56 in the top end 52A of the securing lever 52 is aligned with the hole 50 in the locking bracket 48. A securing lug 58 is mounted between the ends 52A and 52B of the securing lever 52. In the preferred embodiment, the lug 58 is mounted on the securing lever 52 by welding. In the preferred embodiment, the securing lug 58 is mounted closer to the top end 52A of the lever 52 such that when the top end 52A of the lever 52 is unsecured and moved into the unsecured position, the weight of the securing lug 58 at the top end 52A of the lever 52 causes the lever 52 to remain in the unsecured position. In the preferred embodiment, the lever 52 has a length of about 15.5 inches (39.4 cm) and is located about 5.625 inches (14.288 cm) from the top end 52A of the lever 52. The securing lug 58 is preferably cylindrical and has a diameter of 0.75 inches (1.91 cm) and extends outward from the securing lever 52 about 1.625 inches (4.128 cm). It is understood that the diameter and length of the lug 58 are such as to allow the lug 58 to easily extend completely through the securing opening 35 in the post 32 and through the securing opening 14 in the sleeve 12 into the cavity 16B of the hollow cap 16 (FIG. 5).

IN USE

The barrier assembly 10 is intended to be used in an area where a barrier assembly 10 is at times needed to be easily removed and then reinstalled (FIGS. 1 and 2). In the preferred embodiment, the sleeve 12 of the barrier assembly 10 is permanently mounted in the ground surface 100 and remains in the ground surface 100. The assembly 10 can be mounted in soil or concrete or any other ground surface material. In the preferred embodiment, the sleeve 12 is mounted in concrete for maximum durability. The sleeve 12 is preferably positioned about 0.25 inches (0.64 cm) below the top of the ground surface 100. Preferably, the sleeve 12 is positioned in the ground surface 100 such that when the sleeve cover 28 is mounted on the top end 12A of the sleeve 12, the top surface of the sleeve cover 28 is flush with the top of the ground surface 100. The drain conduits 20 with drainage tubes 22 of the sleeve 12 preferably extend from the drain outlets 18 and 26 in the sleeve 12 to a drainage field 24 to allow water trapped in the sleeve 12 to be moved out of and away from the sleeve 12. Preferably, the drainage field 24 is comprised of stone. When the sleeve 12 is mounted in concrete, the drainage tubes 22 must extend beyond the concrete such that the water does not get trapped in the concrete (FIG. 8). This is particularly important for freezing climates where the water in the concrete could freeze causing the concrete to crack. In freezing climates, preferably, the sleeve 12 is embedded in at least 42 inches (107 cm) of concrete measured from the top of the ground surface 100 to the bottom of the concrete. In above freezing climates, the sleeve 12 can be mounted in a minimum of 24 inches (61 cm). The depth in warmer, non-freezing climates is to ensure that the assembly 10 is firmly mounted in the ground surface 100. The sleeve 12 can also be mounted through the surface of a structural member (not shown). When the sleeve 12 is not in use, the sleeve cover 28 is mounted over the open top end 12A of the sleeve 12. The cover 28 prevents debris and liquid from entering the inner chamber 12C of the sleeve 12 and prevents accidents by pedestrians and cyclists. However, since the cover 28 is not a sealed fit, water and other liquids are able to leak into the inner chamber 12C of the sleeve 12 through the open top end 12A. Thus, the need for the drainage outlets 18 and 26.

To mount the post 32 in the sleeve 12, the cover 28 of the sleeve 12 is removed. To remove the cover 28, the cover 28 is lifted off of the top end 12A of the sleeve 12. The chain 30 connecting the cover 28 to the inner chamber 12C of the sleeve 12 prevents the cover 28 from being moved completely away from the sleeve 12. Next, the cover 28 is stored in the bottom end 12B of the sleeve 12. To move the cover 28 into the sleeve 12, the cover 28 is rotated into a vertical position and then angled between the corners of the top end 12A of the sleeve 12. Angling the cover 28 allows the cover 28, which has a size equal to the open top end 12A of the sleeve 12, to slip inside the sleeve 12 through the open top end 12A. When stored in the bottom end 12B of the sleeve 12, the cover 28 is positioned at a vertical angle on one of its sides (FIG. 3). The sleeve 12 is of such a length that the cover 28 can be positioned at a vertical angle in the bottom end 12B of the sleeve 12 without interfering with the insertion of the post 32 into the sleeve 12 (FIG. 3).

Once the cover 28 is removed, the bottom end 32B of the post 32 is inserted into the open top end 12A of the sleeve 12. The post 32 is inserted into the sleeve 12 until the top end 12A of the sleeve 12 encounters the stop ring 34. In alternate embodiments, the bottom portion 132B, 232B or 332B of the post 132, 232 or 332 is inserted into the sleeve 12 until the top portion 132A, 232A or 332A of the post 132, 232 or 332 comes into contact with the top end 12A of the sleeve 12. The post 32 is orientated in the sleeve 12 such that the securing opening 14 in the first sidewall 12D of the sleeve 12 is aligned with the securing opening 35 in the first sidewall 32D of the post 32. In an alternate embodiment, where the post 232 and sleeve (not shown) are cylindrical, the post 232 can be rotated in the sleeve 12 such as to align the securing openings 14 and 35 in the post 232 and sleeve 12 (FIG. 10). In all the embodiments, once the post 32 is fully in the sleeve 12, the securing mechanism 42 is used to lock the post 32 on the sleeve 12 to prevent unauthorized removal.

To secure and lock the post 32 in the sleeve 12, the user slides open the access cover 38 and inserts a hand into the inner chamber 32C of the post 32 and moves the top end 52A of the securing lever 52 away from the access opening 36 toward the first sidewall 32D of the post 32. In the preferred embodiment, the top end 52A of the securing lever 52 is directly across from the access opening 36 such that the end of the securing lever 52 is easy to locate and move (FIG. 4). As the lever 52 is moved, the securing lug 58 moves first into and through the opening 35 in the first sidewall 32D of the post 32 and then into and through the opening 14 in the first sidewall 12D of the sleeve 12 into the cavity 16B of the hollow cap 16. When the top end 52A of the securing lever 52 is in contact with the first sidewall 32D of the post 32, the securing lug 58 is preferably completely through both securing openings 14 and 35 and the securing hole 56 and the top end 52A of the securing lever 52 is aligned with the securing hole 50 in the locking bracket 48. To lock the securing lever 52 in the secured position, a lock 60 is inserted through the hole 56 in the end 52A of the securing lever 52 and through the hole 50 in the locking bracket 48 and locked (FIGS. 3 and 6). The lock 60 is preferably a standard padlock or any other well known padlock-like locking device.

To remove the post 32 from the sleeve 12, the user slides open the access covering 38 and inserts a hand into the inner chamber 32C of the post 32 and unlocks and removes the lock 60. The user then pulls on the top end 52A of the securing lever 52 such as to move the top end 52A of the securing lever 52 toward the access opening 36. Due to the position of the pivot point at the bottom end 52B of the securing lever 52, the securing lever 52 is easily moved to an unsecured position. When the securing lever 52 is moved to the open or unsecured position, the securing lug 58 moves out of the securing openings 14 and 35 which unsecures or releases the post 32 from the sleeve 12. Due to the location of the pivot point of the securing lever 52 and the location of the securing lug 58 on the lever 52, the securing lever 52 remains in the unsecured position until the user moves the securing lever 52 into the secured position. Once released, the post 32 can be removed by lifting the post 32 out of the sleeve 12. Due to the ability of the securing lever 52 to remain in the unlocked position, there is no need for the user to hold the lever 52 in the unlocked position while removing the post 32. This allows the user to have both hands free to lift and maneuver the post 32.

Once the post 32 is removed from the sleeve 12, the sleeve cover 28 is lifted out of the sleeve 12. The cover 28 is then rotated into a horizontal position and placed over the open top end 12A of the sleeve 12. The bottom portion 28B of the cover 28 ensures that the cover 28 remains in the correct position on the top end 12A of the sleeve 12.

It is intended that the foregoing description be only illustrative of the present invention and that the present invention be limited only by the hereinafter appended claims.

We claim:

1. A barrier assembly which comprises:

(a) a sleeve adapted for mounting in a ground surface, the sleeve having opposed first and second ends with a sidewall extending therebetween forming an inner chamber, the sleeve having a first opening in the first end extending into the inner chamber and a second opening in the sidewall of the sleeve with a hollow cap mounted on the sidewall over the second opening and extending outward from the sidewall of the sleeve away from the inner chamber, the hollow cap having a closed end opposite the second opening such as to form an enclosed cavity within the cap;

(b) a post adapted to be removably mounted in the first opening in the first end of the sleeve and having first and second ends with a sidewall therebetween forming an inner chamber, the sidewall having a first opening extending into the inner chamber of the post;

(c) a securing means having opposed ends and pivotably mounted at one end to the sidewall of the post in the inner chamber of the post inside the inner chamber and adjacent to the sleeve, the securing means having a securing lug mounted between the ends and adjacent the first opening in the sidewall of the post, wherein the securing lug extends outward from the securing means and wherein when the post is mounted in the sleeve, the second opening in the sidewall of the sleeve is adjacent the first opening in the sidewall of the post so that in a secured position, the securing lug of the securing means extends through the first opening of the post into the second opening of the sleeve to secure the post in position in the sleeve and wherein once moved into an unsecured position, the securing means remains in the unsecured position to allow for removal of the post and;

(d) a lock inside the inner chamber of the post between the post and the securing means in the post which secures the securing means to the post with the securing lug in the second opening in the sleeve.

2. The post of claim 1 wherein the sleeve and the post have a square cross-section.

3. The post of claim 1 wherein the sleeve and the post have a round cross-section.

4. The post of claim 1 wherein a stop ring is mounted around an outside surface of the post to limit a depth of insertion of the post in the sleeve.

5. The post of claim 1 wherein the post has a top portion adjacent the first end and a bottom portion adjacent the second end and wherein the top portion has a size greater than the opening in the first end of the sleeve so that the top portion contacts the first end of the sleeve to limit a depth of insertion of the post in the sleeve.

6. The post of claim 1 wherein the sleeve is permanently mounted in the ground surface such that the first end of the sleeve is spaced below a top of the ground surface such as to allow a cover to be mounted on the first end of the sleeve with the cover substantially flush with the ground surface.

7. The post of claim 6 wherein the sleeve is mounted in concrete.

8. The post of claim 1 wherein the sleeve has a drainage hole in the second end.

9. The post of claim 1 wherein the sleeve has a drainage hole in the sidewall.

10. The post of claim 1 wherein a locking bracket with a locking hole is mounted on the sidewall of the post in the inner chamber spaced between the first opening in the sidewall of the post and the first end of the post wherein when the securing means is in the secured position, a locking hole in the one end of the securing means is adjacent the locking hole in the locking bracket and the lock is inserted through the locking holes in the securing means and locking bracket to secure the securing means to the locking bracket in the secured position.

11. The post of claim 10 wherein a second opening is provided in the sidewall of the post opposite the locking bracket.

12. The post of claim 11 wherein a movable cover is provided on an outside surface of the sidewall of the post to cover the second opening in the sidewall of the post wherein the cover is moved to allow access to the securing means in the inner chamber of the post.

13. The post of claim 1 wherein a sleeve cover is shaped to fit into the first opening of the sleeve without the post and configured to be able to be stored in the inner chamber of the sleeve between the second end of the sleeve and the second end of the post when the post is mounted on the sleeve and shaped to be positioned over the first opening in the first end of the sleeve when the post is removed from the sleeve, and the cover is removed from the inner chamber of the sleeve.

14. The post of claim 13 wherein the sleeve cover is permanently and movably mounted in the inner chamber of the sleeve.

15. The post of claim 1 wherein the securing means is a lever pivotably mounted at one end adjacent the second end of the post.

16. A method for installing a removable barrier assembly, which comprises the steps of:

(a) providing a barrier assembly having a sleeve adapted for mounting in a ground surface, the sleeve having opposed first and second ends with a sidewall extending therebetween forming an inner chamber, the sleeve having a first opening in the first end extending into the inner chamber and a second opening in the sidewall of the sleeve with a hollow cap mounted on the sidewall over the second opening and extending outward from the sidewall of the sleeve away from the inner chamber, the hollow cap having a closed end opposite the second opening such as to form an enclosed cavity within the cap; a post adapted to be removably mounted in the first opening in the first end of the sleeve and having first and second ends with a sidewall therebetween forming an inner chamber, the sidewall having first and second openings extending into the inner chamber of the post; and a securing means having opposed ends and pivotably mounted at one end to the sidewall of the post in the inner chamber of the post between the first opening in the sidewall of the post and the second end of the post, the securing means having a securing lug mounted between the ends and adjacent the first opening in the sidewall of the post wherein the securing lug extends outward from the securing means and wherein when the post is mounted in the sleeve, the second opening in the sidewall of the sleeve is adjacent the first opening in the sidewall of the post so that in a secured position, the securing lug of the securing means extends through the first opening of the post into the second opening of the sleeve to secure the post in position in the sleeve and wherein once moved into an unsecured position, the securing means remains in the unsecured position to allow for removal of the post;

(b) mounting the sleeve in the ground surface so that the first end of the sleeve is spaced below a top of the ground surface;

(c) inserting the second end of the post into the opening in the first end of the sleeve so that the first opening of the post is adjacent the second opening of the sleeve; and (d) moving the securing means in the inner chamber into the secured position so that the securing lug extends through the second opening of the post and into the second opening of the sleeve.

17. The post of claim 16 wherein a locking bracket having a locking hole is mounted on the sidewall of the post in the inner chamber of the post and wherein to lock the securing means in the secured position, a lock is mounted through the locking hole of the locking bracket and through a locking hole in the securing means.

18. The method of claim 16 wherein to remove the post from the sleeve, the securing means is pivoted away from the first opening in the sidewall of the post so that the securing lug is removed from the hollow cap and second opening in the sidewall of the sleeve and the first opening in the sidewall of the post and the post is lifted out of the sleeve.

19. The method of claim 18 wherein a sleeve cover is positioned in the inner chamber of the sleeve between the second end of the sleeve and the second end of the post when the post is mounted on the sleeve and wherein after the post is removed, the sleeve cover is removed from the inner chamber of the sleeve and positioned over the first opening in the first end of the sleeve.

20. The method of claim 16 wherein a stop ring is mounted on an outside surface of the post and wherein in step (c) the second end of the post is inserted into the inner chamber of the sleeve such that the stop ring is adjacent and in contact with the first end of the sleeve.

* * * * *